US012492065B2

(12) United States Patent
Zorensky et al.

(10) Patent No.: US 12,492,065 B2
(45) Date of Patent: Dec. 9, 2025

(54) PORTABLE HUMIDOR

(71) Applicant: ZB Venture Fund, LLC, Las Vegas, NV (US)

(72) Inventors: Seth Zorensky, Las Vegas, NV (US); Alexander Zorensky, Las Vegas, NV (US); Michael Berkeypile, Henderson, NV (US)

(73) Assignee: ZB Venture Fund, LLC, Las Vegas, NV (US)

( * ) Notice: Subject to any disclaimer, the term of this patent is extended or adjusted under 35 U.S.C. 154(b) by 0 days.

(21) Appl. No.: 18/786,302

(22) Filed: Jul. 26, 2024

(65) Prior Publication Data

US 2025/0042642 A1 Feb. 6, 2025

Related U.S. Application Data

(60) Provisional application No. 63/530,741, filed on Aug. 4, 2023.

(51) Int. Cl.

| | |
|---|---|
| ***B65D 83/02*** | (2006.01) |
| ***A24F 15/14*** | (2006.01) |
| ***A24F 25/02*** | (2006.01) |
| ***B65D 41/02*** | (2006.01) |
| ***B65D 81/22*** | (2006.01) |

(Continued)

(52) U.S. Cl.

CPC ..... *B65D 83/02* (2013.01); *A24F 15/14* (2013.01); *A24F 25/02* (2013.01); *B65D 41/02* (2013.01); *B65D 81/22* (2013.01); *B65D 83/766* (2025.01); *B65D 85/12* (2013.01)

(58) Field of Classification Search

CPC ..... B65D 41/02; B65D 81/22; B65D 81/32; B65D 85/12; B65D 83/02; B65D 83/766

See application file for complete search history.

(56) References Cited

U.S. PATENT DOCUMENTS

| | | | | |
|---|---|---|---|---|
| 1,237,023 A * | 8/1917 | Davidson | ..... | B65D 83/76 312/31 |
| 1,859,731 A * | 5/1932 | Elliott | ..... | A24F 25/00 312/31.3 |
| 2,057,926 A | 10/1936 | Sinclair | | |

(Continued)

FOREIGN PATENT DOCUMENTS

| | | |
|---|---|---|
| GB | 325750 | 2/1930 |

OTHER PUBLICATIONS

Azrin and Powell, "Behavioral Engineering: The Reduction of Smoking Behavior by a Conditioning Apparatus and Procedure," J. Appl. Behavior Analysis , vol. 1, No. 5, p. 193-200 (1968).

*Primary Examiner* — Bryon P Gehman

(74) *Attorney, Agent, or Firm* — Eric B. Fugett; Mark A. Pitchford; Pitchford Fugett, PLLC

(57) ABSTRACT

A portable humidor includes a hollow rectangular housing defining an open upper end, a lower end, and an interior space in which a plurality of cigars is receivable. A follower in the interior space is configured to bias the plurality of cigars toward the open upper end of the housing. A cap is configured to releasably close the open upper end of the housing around the plurality of cigars. The follower, cap, or housing defines a compartment in which a humidifier is receivable to regulate humidity in the interior space when the cap closes the open upper end of the housing. The assembled portable humidor resembles a magazine for a firearm.

18 Claims, 9 Drawing Sheets

(51) Int. Cl.
*B65D 83/766* (2025.01)
*B65D 85/12* (2006.01)

(56) References Cited

U.S. PATENT DOCUMENTS

| | | | | | |
|---|---|---|---|---|---|
| 2,083,465 | A | * | 6/1937 | Mayer | A24F 15/10 221/205 |
| 2,263,374 | A | * | 11/1941 | Yates | F24F 6/04 141/73 |
| 2,519,020 | A | | 8/1950 | Breitwieser | |
| 2,519,438 | A | | 8/1950 | Coney | |
| 3,101,157 | A | | 8/1963 | Russell | |
| 5,205,402 | A | | 4/1993 | Maeda | |
| 2020/0109001 | A1 | * | 4/2020 | Howard | A24F 15/00 |

* cited by examiner

PORTABLE HUMIDOR

CROSS-REFERENCES TO RELATED APPLICATIONS

This non-provisional patent application claims priority to U.S. Provisional Patent Application Ser. No. 63/530,741, filed Aug. 4, 2023 and titled "PORTABLE HUMIDOR," the entire disclosure of which is hereby incorporated by reference.

A portion of the disclosure of this patent document contains material that is subject to copyright protection. The copyright owner has no objection to the reproduction of the patent document or the patent disclosure, as it appears in the U.S. Patent and Trademark Office patent file or records, but otherwise reserves all copyright rights whatsoever.

STATEMENT REGARDING FEDERALLY SPONSORED RESEARCH OR DEVELOPMENT

Not Applicable.

REFERENCE TO SEQUENCE LISTING OR COMPUTER PROGRAM LISTING APPENDIX

Not Applicable.

BACKGROUND OF THE INVENTION

The present disclosure relates generally to the field of storage containers for tobacco products. More specifically, the present disclosure relates to humidors for cigars.

Cigars and similar smoking products must be stored in a humidity-controlled environment to preserve their flavor and extend longevity. Humidors help preserve cigars stored therein by maintaining a desired humidity in an air tight container. Humidors of numerous shapes and sizes are known. For example, traditional "desktop" cigar humidors generally take the form of a bulky wooden box or cabinet in which dozens of cigars can be stored along with a humidity-regulating device known as a humidifying unit or "humidifier." By contrast, portable humidors, known as "travel humidors," are typically much smaller and can only store one or a few cigars.

The most common type of currently available travel humidor takes the form of a rectangular plastic or metal case with a lockable hinged lid that opens like a book when unlocked. These can typically hold several cigars and a humidifier, depending on size and configuration. However, such humidors typically release all humidity inside when a user opens the lid to retrieve or deposit a cigar. This limits the functional life of the humidifier by causing it to dry out prematurely, and thus threatens the flavor and longevity of the remaining cigars stored therein. Additionally, such travel humidors are aesthetically boring due to their traditional boxy shape, which lacks character. Indeed, many individuals interested in firearms and shooting sports enjoy cigars, but disdain traditional desktop humidors and portable humidors for inaccurately reflecting their personality and requiring unnecessary maintenance or care.

Accordingly, what is needed are improvements in portable cigar humidors.

BRIEF SUMMARY

This Brief Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. Features of the presently disclosed invention overcome or minimize some or all of the identified deficiencies of the prior art, as will become evident to those of ordinary skill in the art after a study of the information presented in this document.

It is an object of the present invention to provide a portable humidor that not only stores and humidifies multiple cigars, but also mimics the shape and function of an ammunition magazine for a firearm, such as an AR-15 style or AK-47 style rifle. As such, the portable humidor includes a hollow rectangular body or housing, a removable cap, and a spring-loaded follower in the housing that sequentially dispenses cigars. The follower can include an internal compartment designed to hold a humidifier so that the humidifier can regulate humidity in housing when the cap closes an open upper end of the housing. Cigars in the housing are arranged in a stack similar to how cartridges are arranged in an ammunition magazine. The follower feeds cigars sequentially to the open upper end of the housing for manual access and removal by a user. The open upper end of the housing includes feed lips which retain the stack of cigars in the housing until each is manually sequentially removed by a user. This narrows the mouth of the housing and thereby dramatically limits humidity loss or change within the housing when the cap is removed to deposit or retrieve cigars. It also provides the portable humidor with a novel aesthetic and function not previously seen in cigar humidors.

Numerous other objects, advantages and features of the present disclosure will be readily apparent to those of skill in the art upon a review of the following drawings and description of exemplary embodiments.

BRIEF DESCRIPTION OF THE SEVERAL VIEWS OF THE DRAWINGS

Non-limiting and non-exhaustive embodiments are described with reference to the following figures, wherein like reference numerals refer to like parts throughout the various drawings unless otherwise specified. In the drawings, not all reference numbers are included in each drawing, for the sake of clarity.

Reference will now be made in detail to optional embodiments of the invention, examples of which are illustrated in accompanying drawings. Whenever possible, the same reference numbers are used in the drawing and in the description referring to the same or like parts.

DETAILED DESCRIPTION

The details of one or more embodiments of the present invention are set forth in this document. Modifications to embodiments described in this document, and other embodiments, will be evident to those of ordinary skill in the art after a study of the information provided herein. The information provided in this document, and particularly the specific details of the described exemplary embodiment(s), is provided primarily for clearness of understanding and no unnecessary limitations are to be understood therefrom. In case of conflict, the specification of this document, including definitions, will control.

While the making and using of various embodiments of the present invention are discussed in detail below, it should be appreciated that the present invention provides many applicable inventive concepts that are embodied in a wide variety of specific contexts. The specific embodiments discussed herein are merely illustrative of specific ways to make and use the invention and do not delimit the scope of the invention. Those of ordinary skill in the art will recognize numerous equivalents to the specific apparatus and methods described herein. Such equivalents are considered to be within the scope of this invention and are covered by the claims.

While the terms used herein are believed to be well understood by one of ordinary skill in the art, a number of terms are defined below to facilitate the understanding of the embodiments described herein. Unless defined otherwise, all technical and scientific terms used herein have the same meaning as commonly understood by one of ordinary skill in the art to which the subject matter disclosed herein belongs. The terms defined herein have meanings as commonly understood by a person of ordinary skill in the areas relevant to the present invention. Terms such as "a," "an," and "the" are not intended to refer to only a singular entity, but rather include the general class of which a specific example may be used for illustration. The terminology herein is used to describe specific embodiments of the invention, but their usage does not delimit the invention, except as set forth in the claims.

Figure 1:
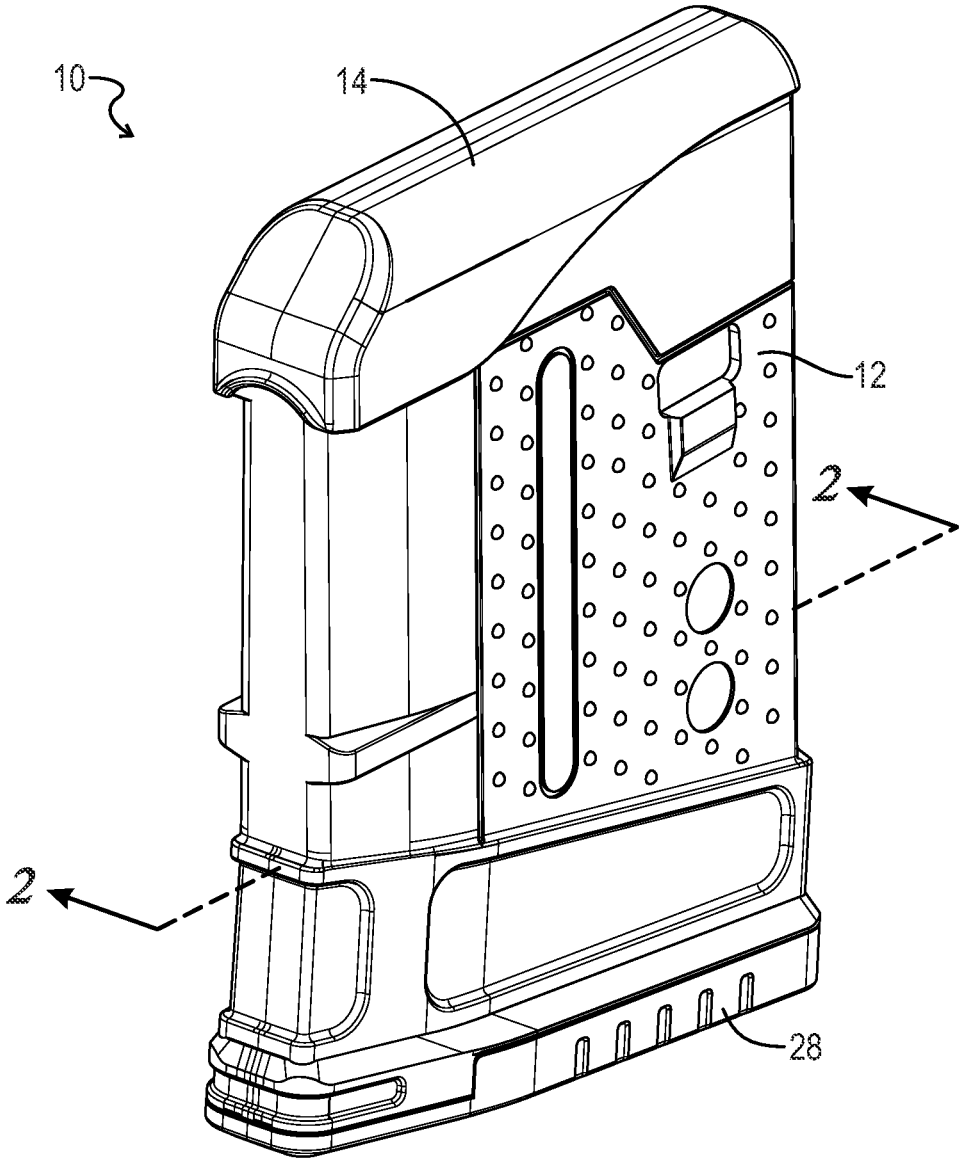
FIG. 1 is an elevated front left-side perspective view of a portable humidor constructed in accordance with an embodiment of the present invention.

As described herein, an "upright" position is considered to be the position of apparatus components while in proper operation or in a natural resting position as described and shown herein, for example, in FIG. 1. "Vertical," "horizontal," "above," "below," "side," "top," "bottom," "upper," "lower," and other orientation terms are described with respect to this upright position during operation, unless otherwise specified, and are used to provide an orientation of embodiments of the invention to allow for proper description of example embodiments. A person of skill in the art will recognize, however, that the apparatus can assume different orientations when in use.

The term "when" is used to specify orientation for relative positions of components, not as a temporal limitation of the claims or apparatus described and claimed herein unless otherwise specified.

The terms "above", "below", "over", and "under" mean "having an elevation or vertical height greater or lesser than" and are not intended to imply that one object or component is directly over or under another object or component.

The phrase "in one embodiment," as used herein does not necessarily refer to the same embodiment, although it may. Conditional language used herein, such as, among others, "can," "might," "may," "e.g.," and the like, unless specifically stated otherwise, or otherwise understood within the context as used, is generally intended to convey that certain embodiments include, while other embodiments do not include, certain features, elements and/or states. Thus, such conditional language is not generally intended to imply that features, elements and/or states are in any way required for one or more embodiments.

All measurements should be understood as being modified by the term "about" regardless of whether the word "about" precedes a given measurement.

The term "cigar" as used herein refers to cigars, cigarettes, and the like made from or containing tobacco, marijuana, and/or other smokable materials. The term "cigar" should also be understood as including generally cylindrical containers in which such items are commonly individually sold or stored (e.g., cellophane and cedar sleeves, as well as aluminum, glass, and plastic tubes).

The terms "significantly", "substantially", "approximately", "about", "relatively," or other such similar terms that may be used throughout this disclosure, including the claims, are used to describe and account for small fluctuations, such as due to variations in manufacturing or processing from a reference or parameter. Such small fluctuations include a zero fluctuation from the reference or parameter as well. For example, they can refer to less than or equal to ±10%, such as less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

The term "substantially seal" as used herein does not require a perfect seal or complete impermeability to water vapor, but rather means to seal within the limits of industry custom or commercially acceptable manufacturing tolerances and practices for portable humidors.

All references to singular characteristics or limitations of the present disclosure shall include the corresponding plural characteristic(s) or limitation(s) and vice versa, unless otherwise specified or clearly implied to the contrary by the context in which the reference is made.

All combinations of method or process steps as used herein can be performed in any order, unless otherwise specified or clearly implied to the contrary by the context in which the referenced combination is made.

The methods and devices disclosed herein, including components thereof, can comprise, consist of, or consist essentially of the essential elements and limitations of the embodiments described herein, as well as any additional or optional components or limitations described herein or otherwise useful.

Referring generally to FIGS. 1-10, there is shown an embodiment of a portable humidor 10 for storing, humidifying, and dispensing cigars 5 and similar products. The humidor 10 generally includes a housing 12, a lid or cap 14, and a spring-loaded follower 16 which contains a humidifier 25. The housing 12 is shaped and sized so as define an interior space 15 in which multiple cigars 5 can be stored in a stacked orientation. Cigars 5 stored in the interior space 15 are stacked on the follower 16, which translates up and down in the interior space 15 and is configured as explained in more detail below to sequentially dispense the cigars 5. The housing 12 is also shaped and sized to resemble the body of a magazine for an AR-15 style firearm. As such, in some embodiments, the housing 12 can be a generally rectangular hollow body as exemplified in the figures. In other embodiments, the housing 12 can be elongated and more arcuate, so as to resemble a high-capacity AR-15 "banana magazine." In still yet other embodiments, the housing 12 can be shaped so as to resemble a magazine for an AK-47 rifle, or other firearm.

Figure 3:
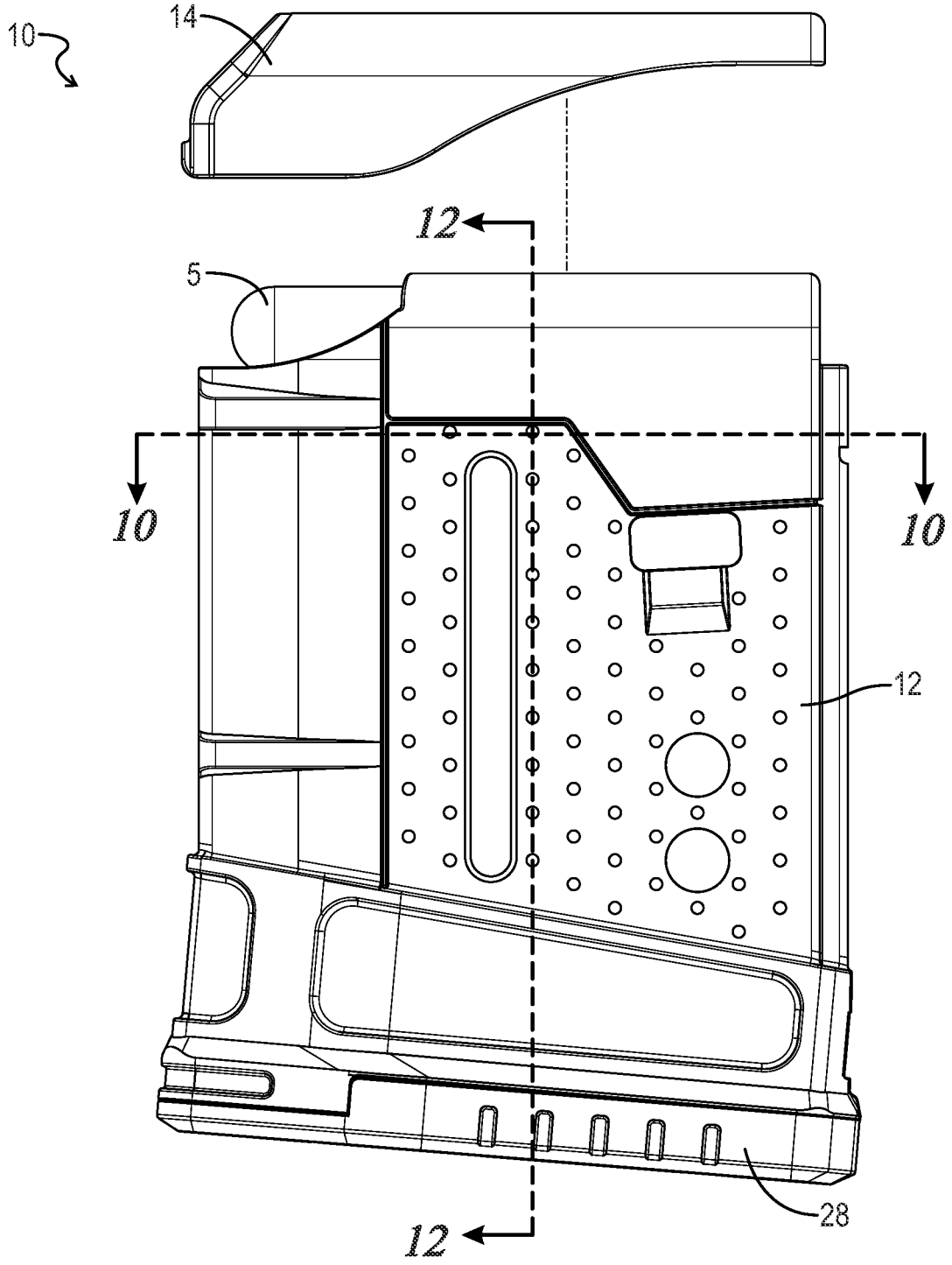
FIG. 3 is a partially exploded left side view of the humidor of FIG. 1.
Figure 4:
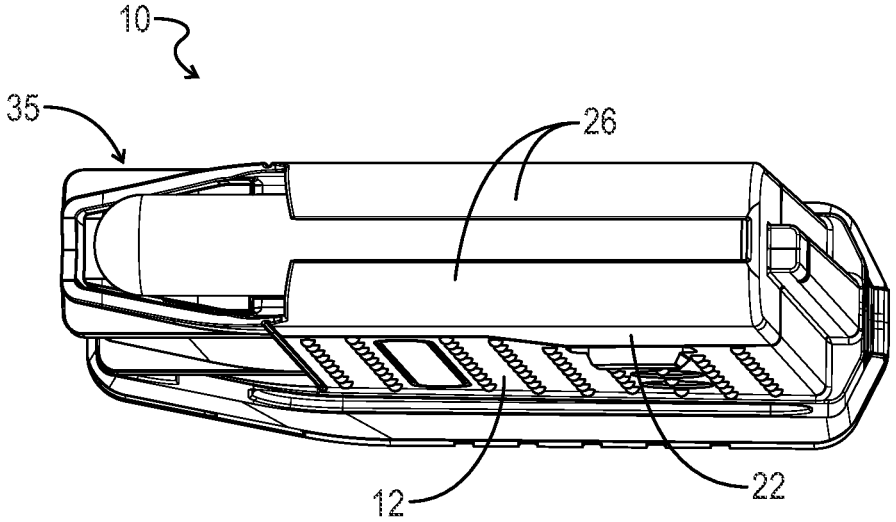
FIG. 4 is a top perspective view of the humidor of FIG. 1. The cap is omitted for clarity.
Figure 5:
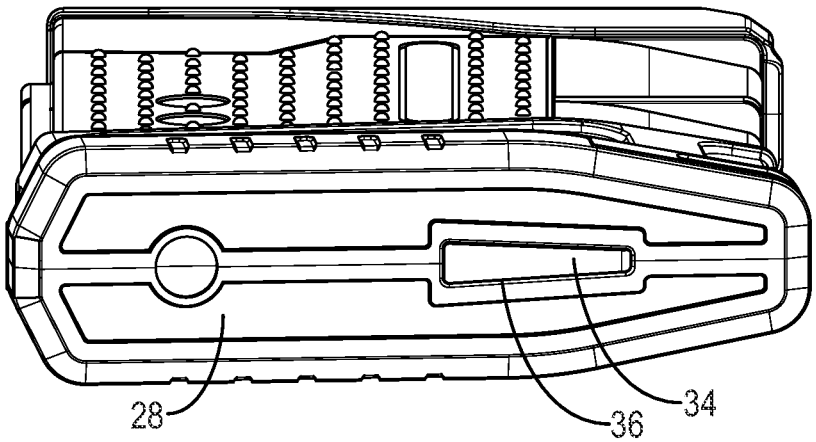
FIG. 5 is bottom perspective view of the humidor of FIG. 1.
Figure 6:
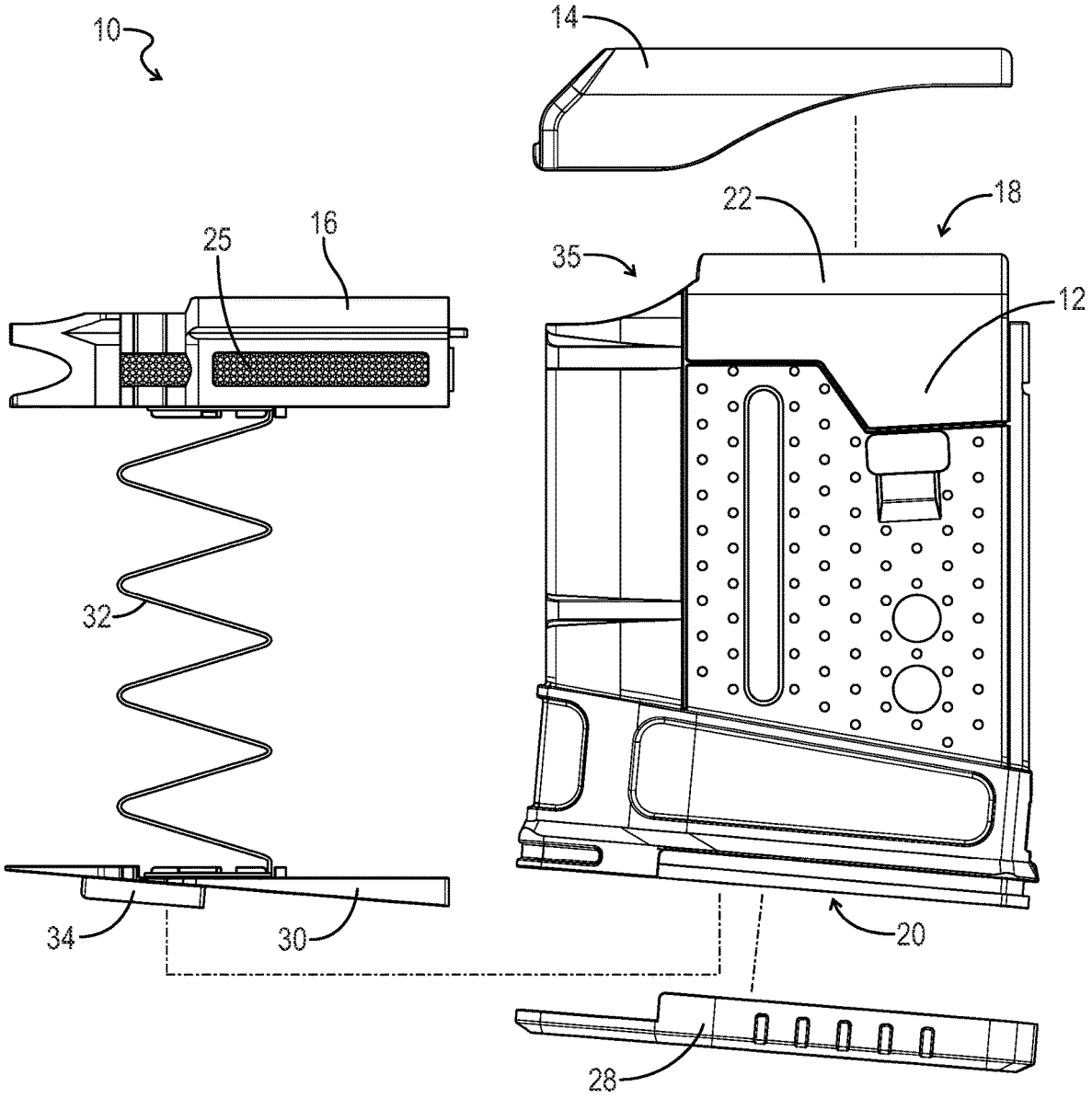
FIG. 6 is a partially exploded left-side view of the humidor of FIG. 1. The cigars are omitted for clarity.
Figure 7:
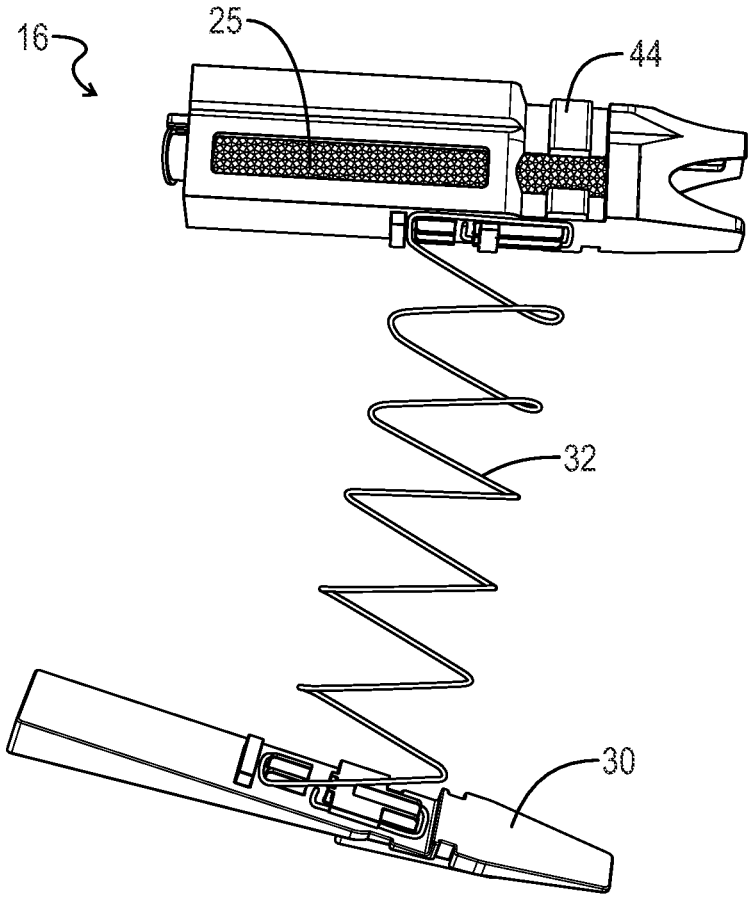
FIG. 7 is a right-side perspective view of the follower, humidifier, follower spring, and lock plate of the humidor of FIG. 1 in isolation.

The housing 12 includes an open upper end 18, a lower end 20, opposing left 22 and right 24 sidewalls, a front wall 66, a back wall or "spine" 68, a pair of opposing feed lips 26, and an opening or mouth 35 through which cigars 5 are movable into and out of the interior space. The feed lips 26 are formed on the corresponding left and right sidewalls 22, 24 at the open upper end 18 of the housing 12. The feed lips 26 curve inwardly toward one another from the sidewalls 22, 24 so as to retain cigars 5 in the upper end 18 of the housing 12 against a force exerted on the cigars 5 by the spring-loaded follower 16. The cap 14 is sized and shaped to fit over the open upper end 18 of the housing 12, as well as any part of a cigar 5 protruding beyond the feed lips 26 into the mouth 35 of the housing 12, as shown in FIG. 3. In this way, the cap 14 closes the open upper end 18 of the housing 12 and helps prevent cigars 5 from being inadvertently dislodged from the humidor 10. In some embodiments, the cap 14 can carry one or more gaskets configured to substantially seal the upper end 18 of the housing 12. In other embodiments, the one or more gaskets can instead be carried on the upper end 18 of the housing 12.

The lower end 20 of the housing 12 is closed by a base member 28. The base member 28 is releasably slidably engaged with the lower end 20 of the housing 12. For example, in the embodiment shown in the figures, the base member 28 defines a pair of opposing grooves 64 in which a corresponding pair of opposing rails 62 extending from the lower end 20 of the housing 12 are slidably received. However, in other embodiments, the lower end 20 of the housing 12 can define the pair of opposing grooves 64, and the base member 28 can define the corresponding pair of opposing rails 62.

The base member 28 is secured on the housing 12 by a locking plate 30 and a metal spring 32. The locking plate 30 is disposed in the interior space 15 against the base member 28. A downwardly extending protrusion 34 on the locking plate 30 matingly engages an aperture 36 in the base member 28. The spring 32 is disposed in the interior space 15 between the follower 16 and the locking plate 30 so as to push against each of the follower 16 and the locking plate 30. An uppermost end of the spring 32 engages and pushes against the follower 16 while a lowermost end of the spring 32 engages and pushes the locking plate 30. The ends of the spring 32 are held in place by corresponding spring mounts on the follower 16 and locking plate 30. As such, the spring 32 biases the follower 16 toward the feed lips 26 and maintains the protrusion 34 of the locking plate 30 in engagement with the aperture 36 of the base member 28, thereby securing or locking the base member 28 on the lower end 20 of the housing 12 and preventing the base member 28 from inadvertently becoming dislodged from the lower end 20 of the housing 12. In some embodiments, the lower end of the housing 12, the base member 28, and/or the locking plate 30 can carry one or more gaskets so as to substantially seal the lower end 20 of the housing 12. In other embodiments, the base member 28 and locking plate 30 can be omitted and the lower end 20 of the housing can be sealed with an integrally formed solid end wall (not shown).

Figure 2:
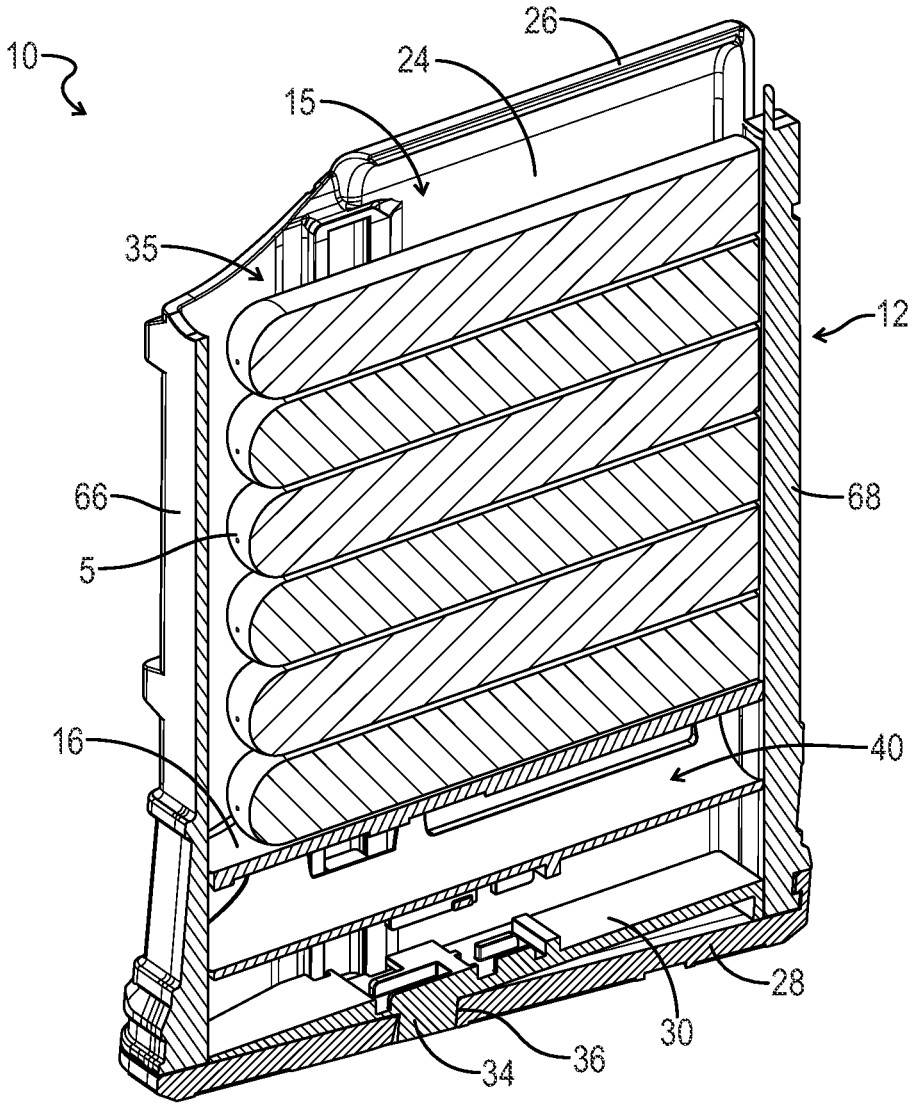
FIG. 2 is a cross-sectional perspective view taken along line 2-2 of FIG. 1. The cap, spring, and humidifier are omitted for clarity. The humidor is shown with additional cigars received therein. The cigars are shown artificially recessed from upper end of the housing so as to better illustrate the structures and geometries formed on the inner surface of the right sidewall thereof.

The follower 16 is disposed within the interior space 15 of the housing 12 and is biased upward toward the feed lips 26 by the spring 32. A semicircular groove or channel 38 is defined in an upper surface of the follower 16. The groove 38 is sized and shaped so as to receive a cigar 5 therein. The groove 38 forms a seat in which the cigar 5 rides, as best shown in FIG. 2. The cigar 5 seated in the groove 38 forms the lowermost cigar 5 in the stack. Additional cigars 5 contained in the interior space 15 are stacked atop each other and the lowermost cigar 5, which rides in the groove 38. The spring-loaded follower 16 carries and biases the stack of cigars 5 toward the feed lips 26 for quick and easy removal by a user. More specifically, the follower 16 biases the cigars 5 upward and positions the uppermost cigar 5 such that it contacts the feed lips 26 and partially extends out of the mouth 35 at the upper end 18 of the housing 12. In other words, the follower 16 sequentially feeds the cigars 5 to the upper end 18 of the housing 12 for access by a user.

In operation, a user can retrieve a cigar 5 from the humidor 10 by removing the cap 14 and manually sliding the topmost or uppermost cigar 5 of the stack out of the mouth 35 from between the feed lips 26 at the upper end 18 of the housing 12. When the topmost cigar 5 is removed, the spring-biased follower 16 automatically pushes or feeds the next cigar 5 in the stack up into position against the feed lips 26 for removal through the mouth 35 by a user as desired. To load cigars 5 into the humidor 10, a user can insert a first cigar 5 through the mouth 35 and under the feed lips 26 at the upper end 18 of the housing 12 until the cigar 5 is received in the interior space 15 and rides in the groove 38 of the follower 16. As can be appreciated, inserting the first cigar 5 gently pushes the follower 16 downward and compresses the spring 32. Additional cigars 5 can be loaded into the humidor 10 by gently pressing down on the topmost cigar 5 with a finger or subsequent cigar 5 and then inserting each subsequent cigar 5 through the mouth 35 and under the feed lips 26 at the upper end 18 of the housing 12 as done for the first (i.e., the lowermost) cigar 5 in the stack. The cigars 5 are retained in in the interior space 15 by virtue of being trapped between the feed lips 26 and the spring-loaded follower 16. Once a desired number of cigars 5 are stored in the humidor 10, the user can replace the cap 14 on upper end 18 of the housing 12.

Figure 8:
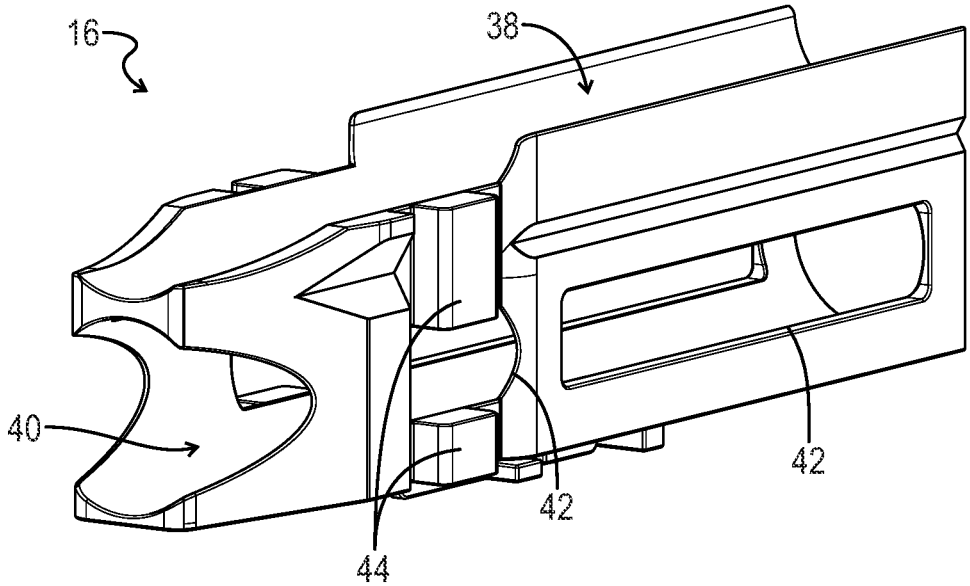
FIG. 8 is an elevated front left-side perspective view of the follower of the humidor of FIG. 1 in isolation.
Figure 9:
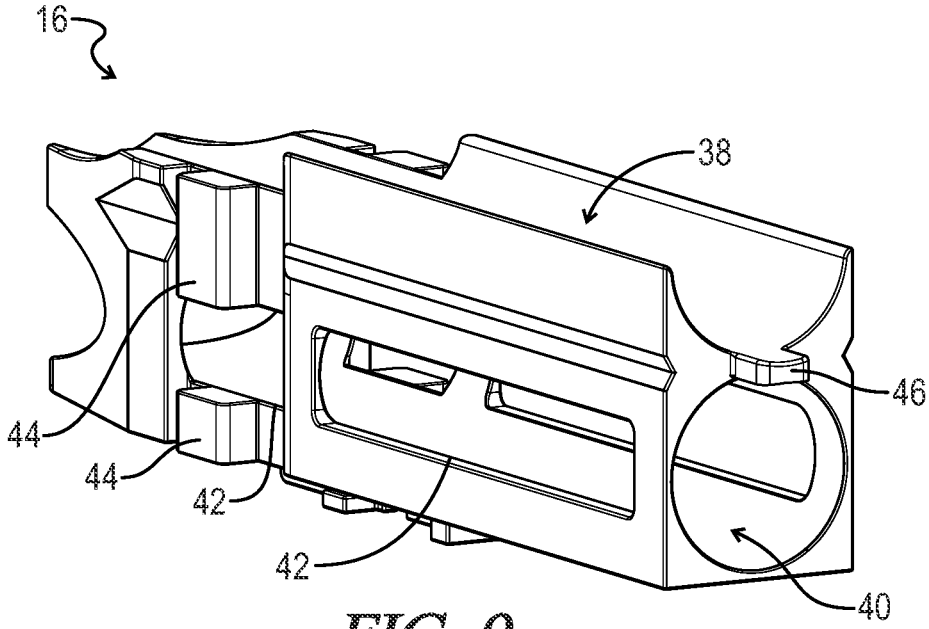
FIG. 9 is an elevated rear left-side perspective view of the follower of FIG. 8.
Figure 10:
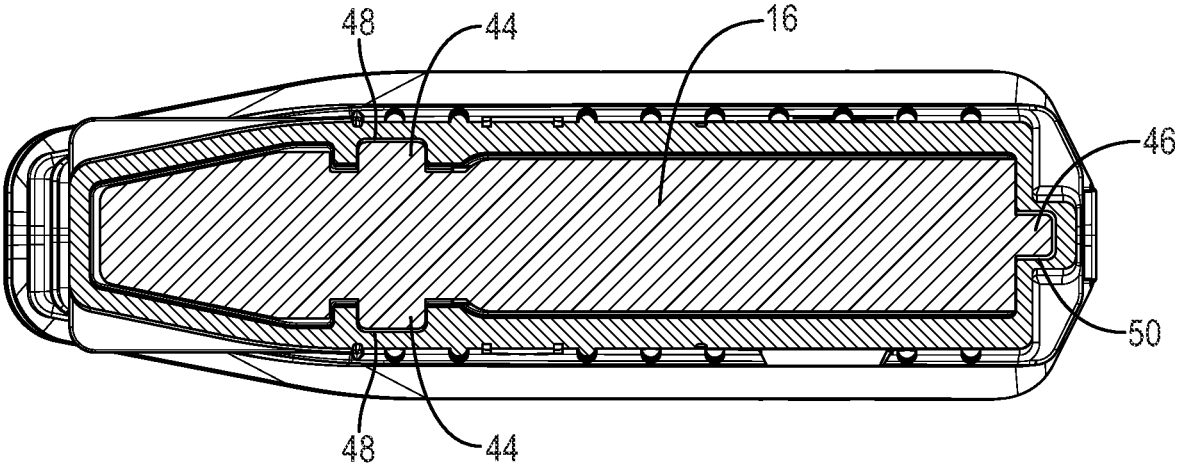
FIG. 10 is a cross-sectional view taken along line 10-10 of FIG. 3.

In some embodiments, the follower 16 also defines a compartment 40 in which a humidifier 25 is receivable to regulate humidity in the interior space 15 when the open upper end 18 of the housing 12 is closed by the cap 14 and the lower end 20 of the housing 12 is closed (whether by an integrally formed end wall or by the base member 28 and locking plate 30). As best shown in FIGS. 8-9, the compartment 40 is open at both ends and includes several vents 42 along its length to increase airflow and thus the distribution of water vapor around the interior space 15. As such, the compartment 40 is in fluid communication with the interior space 15 where cigars 5 are stored. The compartment 40 can be shaped and sized so as to receive virtually any type of humidifier 25.

Figure 11:
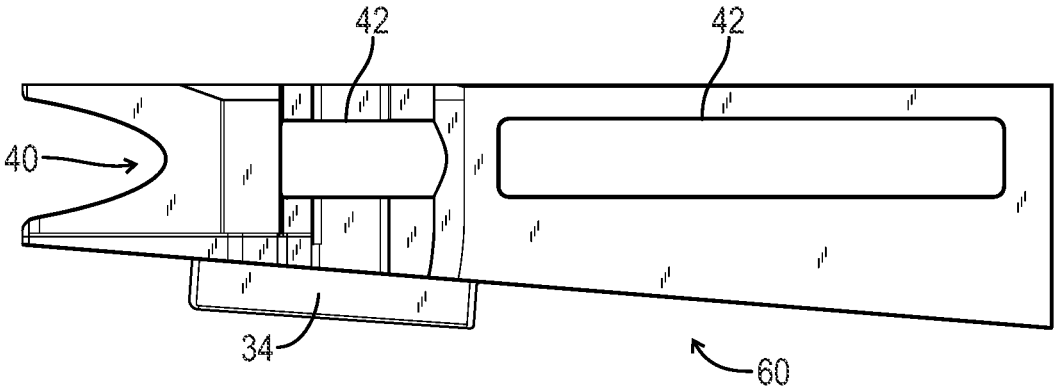
FIG. 11 is a left side elevational view of an alternate embodiment of a lock plate for the humidor of FIG. 1 showing the lock plate in isolation.
Figure 12:
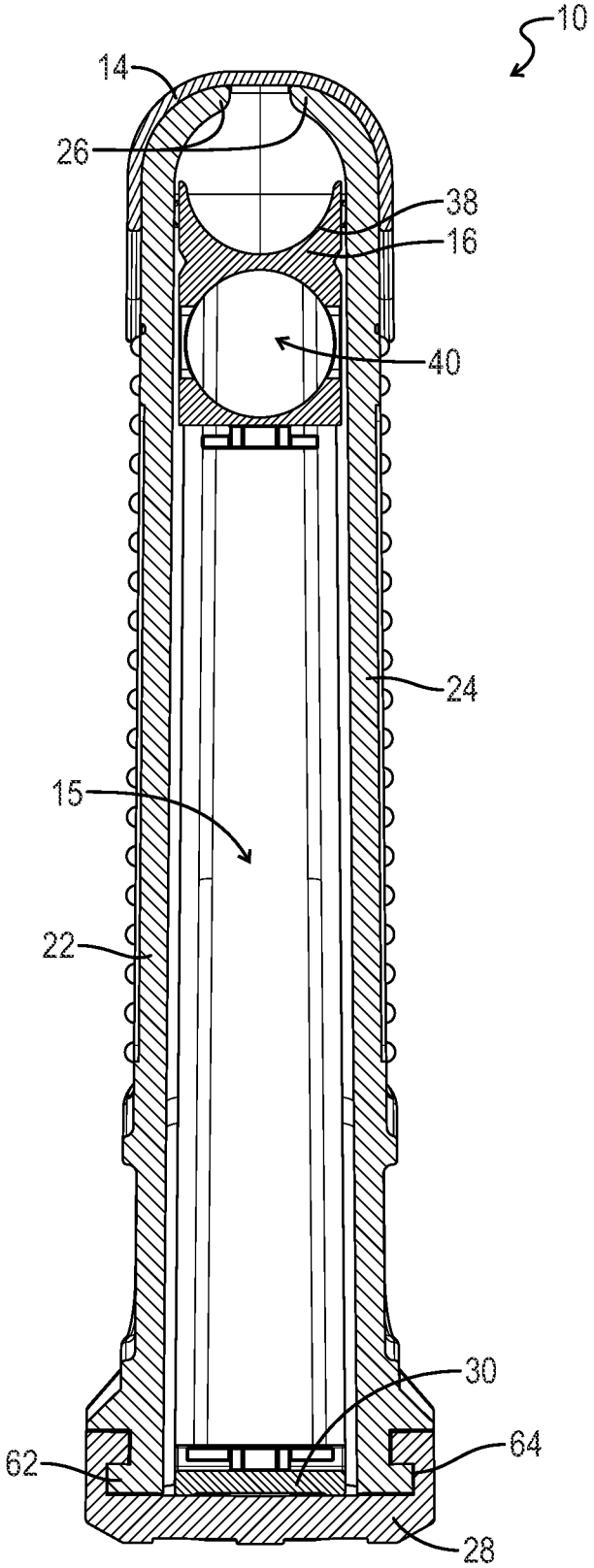
FIG. 12 is a cross-sectional view taken along line 12-12 of FIG. 3. The follower spring is omitted for clarity.

For example, although the humidifier 25 is depicted in the figures as a tube containing glycerin-soaked gel cells, in other embodiments, the compartment 40 can be shaped and sized to receive a different type of humidifying unit, such as a BOVEDA® or INTEGRA™ humidity pack, or another device well known in the art. Additionally, in other embodiments, the humidifier 25 can be integrated into or carried on the cap 14. For example, like follower 16, the lid or cap 14 can include a compartment in which a humidifier 25 is receivable to humidify the interior space 15 when the cap closes the open upper end 18 of the housing 12. In additional embodiments, such as that exemplified in FIG. 11, the compartment 40 and thus the humidifier 25 can be integrated into or carried on a novel lock plate 60. Lock plate 60 is identical in all respects to lock plate 30 except that lock plate 60 is thickened so as to be large enough to define compartment 40 between the protrusion 34 and the upper surface thereof with which the spring interfaces as described above. In still yet additional embodiments (not shown), the compartment 40 can be integrated or carried vertically on the front wall 66 or spine 68 of the housing 12.

The follower 16 also includes protrusions 44, 46 that ride within corresponding tracks 48, 50 formed in the sidewalls 22, 24 and rear end wall 52 of housing 12. The tracks 48, 50 thus guide follower 16 as it translates up and down inside the interior space 15 of housing 12 during use. The track 50 in the rear end wall 52 can also function as a secondary safety stop that prevents the spring 32 from ejecting the follower 16 out of the open upper end 18 of the housing 12. The housing 12, cap 14, follower 16, base member 28, and locking plate 30 can comprise any desired material, such as plastic.

Although embodiments of the present invention have been described in detail, it will be understood by those skilled in the art that various modifications can be made therein without departing from the spirit and scope of the invention as set forth in the appended claims.

This written description uses examples to disclose the invention and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

It will be understood that the particular embodiments described herein are shown by way of illustration and not as limitations of the invention. The principal features of this invention may be employed in various embodiments without departing from the scope of the invention. Those of ordinary skill in the art will recognize numerous equivalents to the specific apparatus and methods described herein. Such equivalents are considered to be within the scope of this invention and are covered by the claims.

All of the compositions and/or methods disclosed and claimed herein may be made and/or executed without undue experimentation in light of the present disclosure. While the compositions and methods of this invention have been described in terms of the embodiments included herein, it will be apparent to those of ordinary skill in the art that variations may be applied to the compositions and/or methods and in the steps or in the sequence of steps of the method described herein without departing from the concept, spirit, and scope of the invention. All such similar substitutes and modifications apparent to those skilled in the art are deemed to be within the spirit, scope, and concept of the invention as defined by the appended claims.

Thus, although there have been described particular embodiments of the present invention, it is not intended that such references be construed as limitations upon the scope of this invention except as set forth in the following claims.

What is claimed is:

1. A portable humidor, comprising:

a housing defining an open upper end, a lower end, left and right sidewalls, and an interior space in which a plurality of cigars is receivable;

a pair of opposing feed lips on the respective left and right sidewalls at the open upper end of the housing;

a follower in the interior space configured to bias the plurality of cigars toward the open upper end of the housing and push an uppermost cigar of the plurality of cigars against the pair of feed lips;

a cap configured to releasably close the open upper end of the housing around the feed lips and the plurality of cigars; and a compartment in which a humidifier is receivable to regulate humidity in the interior space when the cap closes the open upper end of the housing, the compartment in fluid communication with the interior space.

2. The portable humidor of claim 1, wherein the plurality of cigars is arranged in a stack when the plurality of cigars is received in the interior space.

3. The portable humidor of claim 2, wherein the pair of feed lips is configured to retain the plurality of cigars in the interior space until the plurality of cigars are removed therefrom by manually sliding the uppermost cigar and each subsequent underlying cigar out from under the pair of feed lips.

4. The portable humidor of claim 1, wherein the humidifier does not contact the plurality of cigars when the humidifier is received in the compartment and the plurality of cigars is received in the interior space.

5. The portable humidor of claim 1, wherein the compartment is defined by the follower.

6. The portable humidor of claim 1, wherein the compartment is defined by the cap, a front wall of the housing, or a rear wall of the housing.

7. The portable humidor of claim 1, further comprising:

a base member releasably slidably engaged with the lower end of the housing;

a locking plate in the interior space releasably engaged with the base member; and a biasing member in the interior space configured to bias the follower toward the feed lips and maintain the locking plate in engagement with the base member so as to releasably secure the base member on the lower end of the housing.

8. The portable humidor of claim 7, wherein the compartment is defined by the locking plate.

9. The portable humidor of claim 7, wherein the biasing member is a spring extending from the follower to the locking plate.

10. The portable humidor of claim 7, wherein:

the cap is configured to substantially seal the open upper end of the housing when the cap closes the open upper end of the housing; and the base member is configured to substantially seal the lower end of the housing when the base member is secured to the lower end of the housing by the locking plate.

11. The portable humidor of claim 1, wherein the housing is configured to resemble a magazine for a firearm.

12. A portable humidor, comprising:

a housing defining an open upper end, a lower end, left and right sidewalls, and an interior space in which a plurality of cigars is receivable in a stack through the open upper end;

a pair of opposing feed lips on the respective left and right sidewalls at the open upper end of the housing;

a spring-loaded follower in the interior space configured to push an uppermost cigar of the stack against the pair of feed lips; and a cap configured to releasably close the open upper end of the housing around the feed lips and the plurality of cigars;

wherein the follower defines a compartment in which a humidifier is receivable to regulate humidity in the interior space when the cap closes the open upper end of the housing.

13. The portable humidor of claim 12, wherein the pair of opposing feed lips is configured to retain the plurality of cigars in the interior space until the plurality of cigars is removed therefrom by manually sliding the uppermost cigar and each subsequent cigar underlying the uppermost cigar out from under the pair of feed lips.

14. The portable humidor of claim 12, further comprising:

a base member releasably slidably engaged with the lower end of the housing; and a locking plate in the interior space releasably engaged with the base member;

wherein the spring is configured to bias the follower toward the feed lips and maintain the locking plate in engagement with the base member so as to releasably secure the base member on the lower end of the housing.

15. The portable humidor of claim 14, wherein:

the cap is configured to substantially seal the open upper end of the housing when the cap closes the open upper end of the housing; and the base member is configured to substantially seal the lower end of the housing when the base member is secured to the lower end of housing by the locking plate.

16. A portable humidor, comprising:

a housing defining an open upper end, a lower end, left and right sidewalls, and an interior space into which a plurality of cigars is receivable through the open upper end;

a cap configured to releasably close the open upper end of the housing around the open upper end and the plurality of cigars;

a follower slidably received in the interior space configured to bias the plurality of cigars toward the open upper end of the housing, the follower defining a compartment in fluid communication with the interior space;

a pair of opposing feed lips on the respective left and right sidewalls at the open upper end of the housing configured to retain the plurality of cigars in the interior space until each cigar of the plurality is manually removed therefrom; and a humidifier removably receivable in the compartment to regulate humidity in the interior space when the cap closes the open upper end of the housing.

17. The portable humidor of claim 16, further comprising:

a base member releasably slidably engaged with the lower end of the housing;

a locking plate in the interior space releasably engaged with the base member; and a spring in the interior space extending from the follower to the locking plate, the spring configured to bias the follower toward the feed lips and maintain the locking plate in engagement with the base member so as to releasably secure the base member on the lower end of the housing.

18. The portable humidor of claim 17, wherein:

the cap is configured to substantially seal the open upper end of the housing when the cap closes the open upper end of the housing; and the base member is configured to substantially seal the lower end of the housing when the base member is secured to the lower end of the housing by the locking plate.

* * * * *